US011156388B2

(12) United States Patent
Durand

(10) Patent No.: US 11,156,388 B2
(45) Date of Patent: Oct. 26, 2021

(54) CRYOGENIC REFRIGERATION DEVICE

(71) Applicant: L'Air Liquide, Societe Anonyme pour l'Etude et l'Exploitation des Procedes Georges Claude, Paris (FR)

(72) Inventor: Fabien Durand, Voreppe (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 0 days.

(21) Appl. No.: 16/075,792

(22) PCT Filed: Jan. 17, 2017

(86) PCT No.: PCT/FR2017/050098
§ 371 (c)(1),
(2) Date: Aug. 6, 2018

(87) PCT Pub. No.: WO2017/137674
PCT Pub. Date: Aug. 17, 2017

(65) Prior Publication Data

US 2019/0063791 A1 Feb. 28, 2019

(30) Foreign Application Priority Data

Feb. 8, 2016 (FR) ..... 1650962

(51) Int. Cl.
*F25J 1/02* (2006.01)
*F25B 9/14* (2006.01)
*F25B 9/00* (2006.01)

(52) U.S. Cl.
CPC ..... *F25B 9/14* (2013.01); *F25B 9/002* (2013.01); *F25B 2309/001* (2013.01); *F25B 2400/073* (2013.01)

(58) Field of Classification Search
CPC .. F25J 1/0065; F25J 1/007; F25J 15/30; F25J 2270/30; F25B 9/14; F25B 2309/001
See application file for complete search history.

(56) References Cited

U.S. PATENT DOCUMENTS 4,267,701 A * 5/1981 Toscano ..... F25J 1/0007 62/402
5,205,134 A * 4/1993 Gistau-Baguer ..... F25B 9/06 62/335

(Continued)

FOREIGN PATENT DOCUMENTS

| | | |
|---|---|---|
| FR | 2 084 109 | 12/1971 |
| FR | 2 924 205 | 5/2009 |
| SU | 1 305 506 | 4/1987 |

OTHER PUBLICATIONS

FR2084109 Translation (Year: 1971).*

(Continued)

*Primary Examiner* — Brian M King
(74) *Attorney, Agent, or Firm* — Christopher J. Cronin

(57) ABSTRACT

Cryogenic refrigeration device comprising a working circuit intended to cool a working fluid circulating in the said circuit, the working circuit comprising, arranged in series in a loop: a compression portion, a cooling portion, a portion with valve(s), an expansion portion and a reheating portion, in order to subject the working fluid to a recuperative working cycle comprising compression, then cooling, then expansion and then reheating to prepare for a new cycle, wherein the compression portion comprises at least one compressor having a linear piston driven by a linear motor, the expansion proportion comprises at least one expander with a linear piston, the portion with valve(s) comprises at least one regulating valve linearly actuated by a linear motor (Continued)

and controlled in order to supply or extract the working fluid from the at least one expansion piston.

17 Claims, 1 Drawing Sheet

(56) References Cited

U.S. PATENT DOCUMENTS

| | | | | |
|---|---|---|---|---|
| 5,799,867 | A * | 9/1998 | Misawa | F25B 27/00 237/2 B |
| 2012/0174610 | A1* | 7/2012 | Takayama | F25B 1/10 62/196.1 |
| 2013/0305751 | A1* | 11/2013 | Gomes | F25D 11/02 62/89 |
| 2015/0052887 | A1 | 2/2015 | Dadd | |
| 2015/0369528 | A1* | 12/2015 | Lee | F25B 43/003 62/473 |

OTHER PUBLICATIONS

International Search Report and Written Opinion for PCT/FR2017/050098, dated May 18, 2017.
French Search Report and Written Opinion for FR 1 650 962, dated Oct. 28, 2016.

* cited by examiner

CRYOGENIC REFRIGERATION DEVICE

CROSS-REFERENCE TO RELATED APPLICATIONS

This application is a § 371 of International PCT Application PCT/FR2017/050098, filed Jan. 17, 2017, which claims § 119(a) foreign priority to French patent application FR 1 650 962, filed Feb. 8, 2016.

BACKGROUND

Field of the Invention

The invention relates to a cryogenic refrigeration device.

The invention relates more particularly to a cryogenic refrigeration device comprising a working circuit intended to cool a working fluid circulating in said circuit, the working circuit comprising, arranged in series in a loop, a compression portion, a cooling portion, a portion with valve(s), an expansion portion and a reheating portion, in order to subject the working fluid to a recuperative working cycle comprising compression, then cooling, then expansion and then reheating to prepare for a new cycle.

The invention also relates to a cryogenic gas liquefaction unit comprising such a refrigeration device.

Related Art

A concern for the constant improvement of existing cryogenic refrigerators or liquefaction units proposes to increase their service life, reduce the minimum operating temperature and increase their reliability. In particular, it is especially advantageous to eliminate maintenance operations and to phase out the use of oils.

A first known solution involves the use of a regenerative thermodynamic cycle of the Stirling or Pulse-Tube type. The disadvantages of these regenerative solutions are as follows. These devices have low performances at temperatures below 30K. This is associated with the low thermal capacity of the materials constituting the regenerator at this level of temperature. In addition, in these solutions, it is relatively difficult to connect the refrigerator thermally to the system to be cooled as well as to the heat removal system.

Another solution involves the use of a recuperative thermodynamic cycle of the reverse Brayton type based on a lubricated screw compressor, a counter-flow plate exchanger and a centripetal expansion turbine. This solution has the disadvantage, however, of using oil to cool and lubricate the compressor. This imposes the need for a cycle gas de-oiling operation after compression. In addition, the service life of this type of system is relatively short as a result of the compression technology used and as a result of the leaks at the level of the compressor. This technology also presents problems for the expansion of a diphasic fluid, and the energy efficiency is not optimal.

Yet another solution involves the use of a recuperative thermodynamic cycle of the reverse Turbo-Brayton type based on dry centrifugal compressors, a counter-flow plate exchanger and a centripetal expansion turbine (cf. FR2924205A1). This solution is poorly adapted to the low thermal inputs, however, as a result of the difficulty in miniaturizing the turbomachines that are utilized.

In addition, the rates of compression that are achievable at each stage of centrifugal compression is relatively low as a result of the low molar mass of the available gases at cryogenic temperature. The cost of manufacture of such turbomachines is relatively high, furthermore, and the centripetal machines that are utilized are poorly adapted for expanding a diphasic fluid.

SUMMARY OF THE INVENTION

One aim of the present invention is to address all or part of the shortcomings of the prior art mentioned above.

For this purpose, the device according to the invention, which is consistent, furthermore, with the generic definition provided by the above preamble, is essentially characterized in that the compression portion comprises at least one compressor with a linear piston driven by a linear motor, the expansion portion comprises at least one expander with a linear piston, the portion with valve(s) comprises at least one regulating valve of the linear type actuated by a linear motor and controlled in order to supply or extract the working fluid to or from the at least one piston expander.

Furthermore, embodiments of the invention may include one or a plurality of the following characterizing features

- the device comprises at least one expander with a linear piston coupled to the linear motor which drives at least one compressor with a linear piston, that is to say at least one linear motor couples both an expander with a linear piston and a compressor with a linear piston,
- the device comprises at least one regulating valve of the linear type coupled to the linear motor which drives at least one compressor with a linear piston, that is to say at least one linear motor couples both a compressor with a linear piston and a regulating valve of the linear type,
- the device comprises at least one expander with a linear piston coupled to a linear alternator separate from the motor of the at least one compressor, that is to say at least one linear alternator couples an expander with a linear piston said alternator,
- the working fluid is cooled to a temperature between 4K and 200 K,
- the compression portion of the working circuit comprises a plurality of compressors with a linear piston,
- the expansion portion of the working circuit comprises a plurality of expanders with a linear piston each associated with a respective regulating valve (9) of the linear type,
- the working circuit comprises a high-pressure line connecting a high-pressure outlet of a compressor to the inlet of an expander, said high-pressure outlet comprising a non-return valve system, at least one heat exchanger for cooling the compressed gas, and a regulating valve of the linear type,
- the working circuit comprises a low-pressure line connecting an outlet of an expander to the inlet of a compressor, said low-pressure line comprising, a regulating valve of the linear type, at least one heat exchanger for reheating the expanded gas and a non-return valve system,
- the at least one heat exchanger comprises a counter-flow heat exchanger bringing the working fluid circulating in the high-pressure and low-pressure line into thermal exchange,
- the at least one heat exchanger brings the working fluid into thermal exchange with at least one fluid from among water, air, nitrogen, helium, hydrogen, methane, neon, oxygen or argon,
- the at least one regulating valve of the linear type is actuated by its linear motor at the same frequency as the operating frequency of the expander with a linear piston, for which the valve controls the supply or the withdrawal of working fluid, albeit in an out-of-phase manner in relation to the actuation of the piston expander, the device comprises two compressors with a linear piston arranged in series, the working circuit comprising a first high-pressure line connecting a high-pressure outlet of a first compressor to the inlet of a second compressor via a non-return valve system and a second high-pressure line connecting a high-pressure outlet of the second compressor to the inlet of the first compressor via at least one heat exchanger in thermal exchange with the working fluid, a system of non-return valve(s), at least one and preferably two regulating valves of the linear type and at least one and preferably two expanders with a linear piston, the at least one regulating valve being controlled in order to transfer fluid coming from the compressors and having exchanged thermally with the at least one heat exchanger to the at least one expander and then in order to transfer the expanded fluid coming from the at least one expander in the compressors with an intermediate thermal exchange with at least one heat exchanger, the working circuit comprises a phase separator arranged downstream of at least one regulating valve in order to liquefy at least one part of the working fluid at the outlet of an expander and to separate the liquid phase from the gaseous phase of the latter, the working circuit comprises a line for sampling liquefied working fluid and a line for supplying working fluid to the circuit in gaseous form, the working circuit subjects the working fluid to a thermodynamic cycle selected from among a Brayton cycle, a Joule-Thomson cycle, a Claude cycle, the working circuit is closed (or, respectively, open), that is to say the working fluid is not (or, respectively, is), withdrawn from the circuit, the working fluid always circulates in the same direction in the working circuit, that is to say the working fluid does not pass back and forth a number of times in a same line of the circuit between two working circuit devices, the refrigerator transfers heat from the user device (cold source) to a heat source (device at a higher temperature than the cold source), the at least one linear motor is of the type having a flexible bearing or a gas bearing or magnetic bearings, the at least one compressor with a linear piston is of the "dry" type, that is to say not bringing the working fluid into contact with lubricating oil, the at least one expander with a linear piston is of the "dry" type, that is to say not bringing the working fluid into contact with lubricating oil, the at least one valve is of the "dry" type, that is to say not bringing the working fluid into contact with lubricating oil, the working fluid comprises at least one from among helium, hydrogen, nitrogen, methane, neon, oxygen or argon, the at least one regulating valve forms a piston expander, in particular for gaseous, liquid or diphasic working fluid, the at least one expander with a linear piston coupled to the linear motor of a compressor with a linear piston is configured to transfer mechanical work of expansion of the working fluid from the expander to the compressor via a shaft motor of said motor, at least one derivation is provided in the working circuit in order to expand a part of the working fluid in an expander from among a plurality of expanders, all or part of the working fluid expanded in one of the expanders may be returned to the one or more compressors via a return line connected at an intermediate level determined by the low-pressure line.

The invention exhibits numerous advantages in relation to the prior art, in particular by comparison with a regenerative cycle (of the pulse-tube type, in which the working fluid passes back and forth a number of times between a compressor and a regenerator), the device according to the invention which utilizes a recuperative cycle (the working circuit forms a loop of different structure in which the working fluid always circulates in the same direction) makes it possible to achieve very low temperatures, typically 4 K, the use of a compressor with one or more pistons makes it possible to achieve high rates of compression, in particular up to ten per compression stage. By comparison with a cycle using centrifugal compressors, this characterizing feature makes it possible to reduce the flow rate of the cycle and to increase the efficiency of the cycle, having regard for the low number of moving components and the simplicity of the system, the refrigerator possesses high reliability. The compressor does not require the transmission of mechanical power by a speed multiplier or universal joints, the device requires little or no maintenance, the service life of a suchlike device is typically several decades, the recuperative cycle according to the invention makes it possible to connect the refrigerator easily to the system to be cooled, for example via a plate exchanger, and also to the heat evacuation system, for example via a shell and tube exchanger, the recuperative cycle according to the invention makes it possible to relocate the system to be cooled away from the compression/expansion machines, and the system for the removal of heat away from the compression/expansion machines via tubes, the modularity of the device makes it possible to adapt it to a multitude of different needs. For example, it is possible to extract heat at a plurality of temperature levels, the absence of oil in the device makes it possible to connect it directly to a system to be cooled which would not tolerate this type of pollution, advantageously, the refrigerator does not use any oil for lubrication or cooling. This eliminates the installation of de-oiling downstream of the compressor, as well as the operations for the treatment and recycling of used oils, the expansion work of the piston expander may be evaluated and utilized by the compressor, the device may be devoid of rotating or sliding joints, the system then being totally hermetic in relation to the exterior. This prevents any loss or pollution of the cycle gas, the device makes it possible to expand a diphasic fluid and to replace the Joule Thomson expander, for example on a Joule Thomson cycle or Claude cycle, by an expander with recuperation of work, contrary to the existing piston expanders using complicated mechanical systems requiring lubrication and maintenance in order to actuate the valves of the expander, the device utilizes a simpler mechanism, of which the service life is typically several decades, The invention also relates to a method for the refrigeration of a user device by means of such a cryogenic refrigeration device, in which the cooled working fluid is placed into thermal exchange with said user device.

The invention also relates to a liquefaction unit or a liquefaction method comprising or utilizing such a refrigeration device.

The invention may also relate to any alternative device or method comprising any combination of the characterizing features mentioned above or below.

BRIEF DESCRIPTION OF THE FIGURES

Other features and advantages will become apparent from a perusal of the following description, given with reference to the figures, in which.

DETAILED DESCRIPTION OF THE INVENTION

Figure 1:
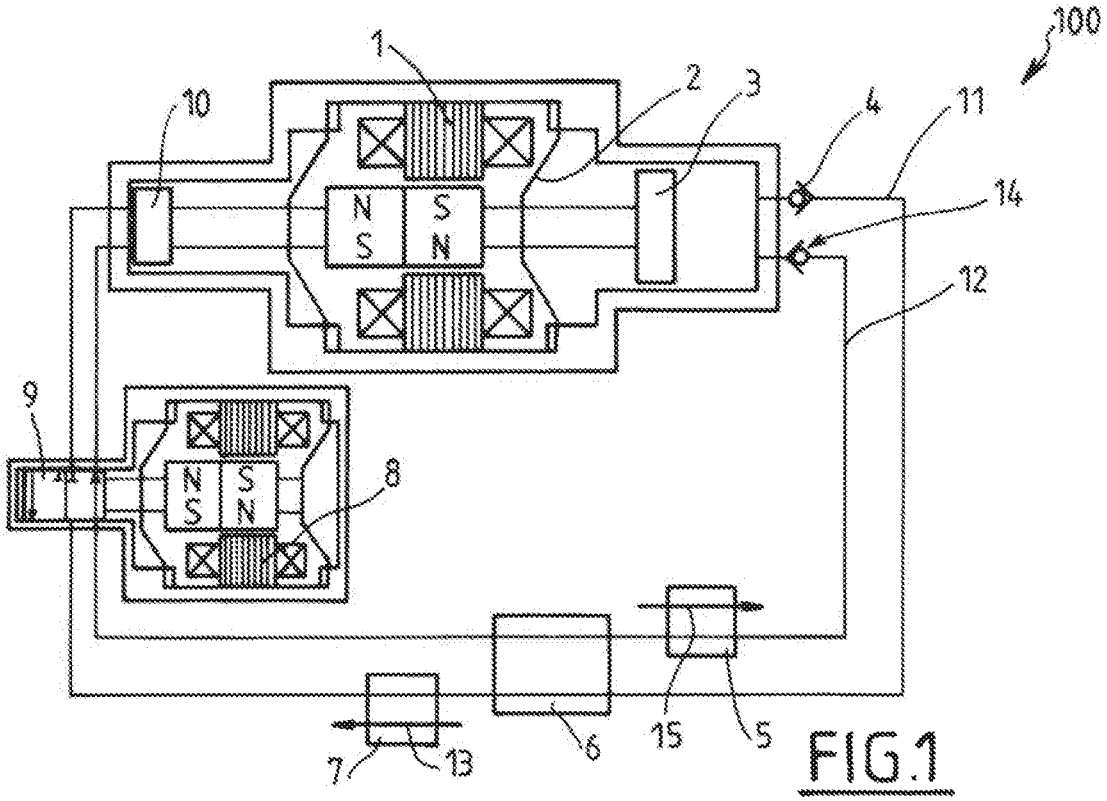
FIG. 1 depicts a schematic and partial view illustrating an example of the structure and operation of a refrigeration device according to the invention.

The non-exhaustive illustrative embodiment illustrated in FIG. 1 is a cryogenic refrigerator, for example having a cold temperature of 77 k, capable of liquefying the nitrogen to saturation.

The refrigeration device 100 preferably has as its aim to transfer heat from a cold source 13 at low temperature (via a thermal exchange with a device or a user 7 to be cooled) to a heat source 15 at a higher temperature (for example via a thermal exchange with a cooling device 5).

As illustrated in FIG. 1, the device comprises a working circuit for a working fluid (for example helium). The working circuit forms a loop in which the working fluid circulates in a single direction by being subjected to a thermodynamic cycle of the recuperative type.

The device may include all or part of the components described below.

The device comprises one or a plurality of linear motors 1 preferably using flexible bearings 2 (or gas or low-friction or magnetic bearings). The bearings represented by way of example in FIG. 1 are of the flexible bearing type.

The circuit comprises one or a plurality of piston compressors 3 arranged in series functioning preferably at ambient temperature and driven by the one or more linear motors 1. The piston compressor is in fact a piston compressor with linear displacement driven by a motor 1. The piston is coupled to a shaft that is displaced in translation according to an alternating movement via a motor, for example an electromagnetic motor, of which the alternating movement of translation of the integral shaft of the piston is driven by a system of magnetic coils (cooperating with magnets that are integral with the shaft or integral with a stator).

These piston compressors 3 utilize non-return valves 4 and 14, for example, in order to communicate with high-pressure lines 12 (to hold back the compressed fluid) and low-pressure lines 11 (to receive the expanded fluid for the purpose of re-compressing it). A plurality of non-return valve technologies are conceivable, for example reed valves. Of course, any other type of device making it possible to prevent the return of the compressed fluid in the opposite direction in the circuit may be envisaged.

The working circuit comprises one or a plurality of exchangers 5 provided in order to remove heat from the compressed gas to a heat source and arranged at the outlet of the one or more compressors 3. This cooling exchanger, for example, brings the working fluid into thermal exchange with a cooling heat transfer fluid 15.

At least one counter-flow heat exchanger 6 is then provided (downstream in the direction of circulation of the working fluid in the circuit on the high-pressure line 12). This heat exchanger 6 may separate the elements relatively at a high temperature from the elements at a relatively low temperature 6 of the circuit.

The circuit then comprises at least one valves 9 operating at low temperature (that is to say between 4 and 200 K). This valve 9 is provided in order to supply and extract the gas from a piston expander 10 situated downstream.

This valve 9 may be actuated by a linear motor 8 of equivalent technology to the technology of the compressor motor 1.

This valve 9 may be coupled equally to the motor 1 of the compressor 3 or to a separate motor. Likewise, the expander 10 may be coupled equally to the motor 1 of the compressor or to the motor 8 of the valve 9 or to a separate alternator (this linear alternator may be of equivalent technology to the technology of the motor 1 described above This alternator has a structure of the same type as the one or more motors of the compressor, for example, but utilized in an alternator mode. That is to say the piston is displaced by the fluid and produces energy).

This valve 9 is actuated preferably at the same frequency as the expander 10, although its movement is out of phase in relation to the expander 10 in such a way as to maximize the efficiency of the expander 10.

The one or more piston expanders 10 operate at low temperature and may or may not be connected mechanically to the motor 1 of the compressor.

The gas expanded by the expander 10 is returned to the compressor 3 via a low-pressure line 11 (through the valve 9). One or a plurality of heat exchangers 7 are provided in order to reheat the working fluid and thus to extract heat to the cold source 13. The expanded fluid passes in particular into the counter-flow exchanger 6 before returning into the compressor 3 (via the corresponding valve 4).

The operation of this refrigerator 100 may be the following. The working gas (helium in this example) in the gaseous phase (for example at 20° C.) is compressed on its way through the piston compressor 3 from a low pressure (for example 10 bar) to a high pressure (for example 18 bar).

The non-return valves 4, 14 are utilized to cause the compression chamber of the compressor to communicate alternately with the low-pressure line 11 and the high-pressure line 12.

The helium is reheated at the outlet of the compressor (for example to 110° C.). The helium is then cooled on its way through a first exchanger 5 with the help of a flow of water 15 (or any other appropriate cooling agent). The temperature of the helium is brought to 25° C.

The helium then passes through the counter-flow exchanger 6, where its temperature is lowered, for example to 79K. Downstream, the regulating valve 9 is utilized in order to cause the expansion chamber of the expander 10 to communicate alternately with the low-pressure line 11 and the high-pressure line 12.

The helium passes through the piston expander 10, where its temperature falls (for example to 67 K). This piston expander 10 is configured in particular in order to function with a diphasic or liquid fluid.

When the expander is coupled to the motor of the compressor, the expansion work of the expander 10 may be transferred via the common shaft of the linear motor 1 to the compressor 3.

The helium then passes through the reheat heat exchanger 7, where it cools the cold user device 13 (nitrogen in this example). The cooled gaseous nitrogen 13 is liquefied to saturation, for example by extracting heat from it.

The temperature of the helium is brought to 76 K, for example.

The helium then passes once more through the counter-flow exchanger 6, where it is reheated (for example to 20° C.).

The helium then returns into the compressor 3 in order to perform a new identical cycle via the valve 4.

Figure 2:
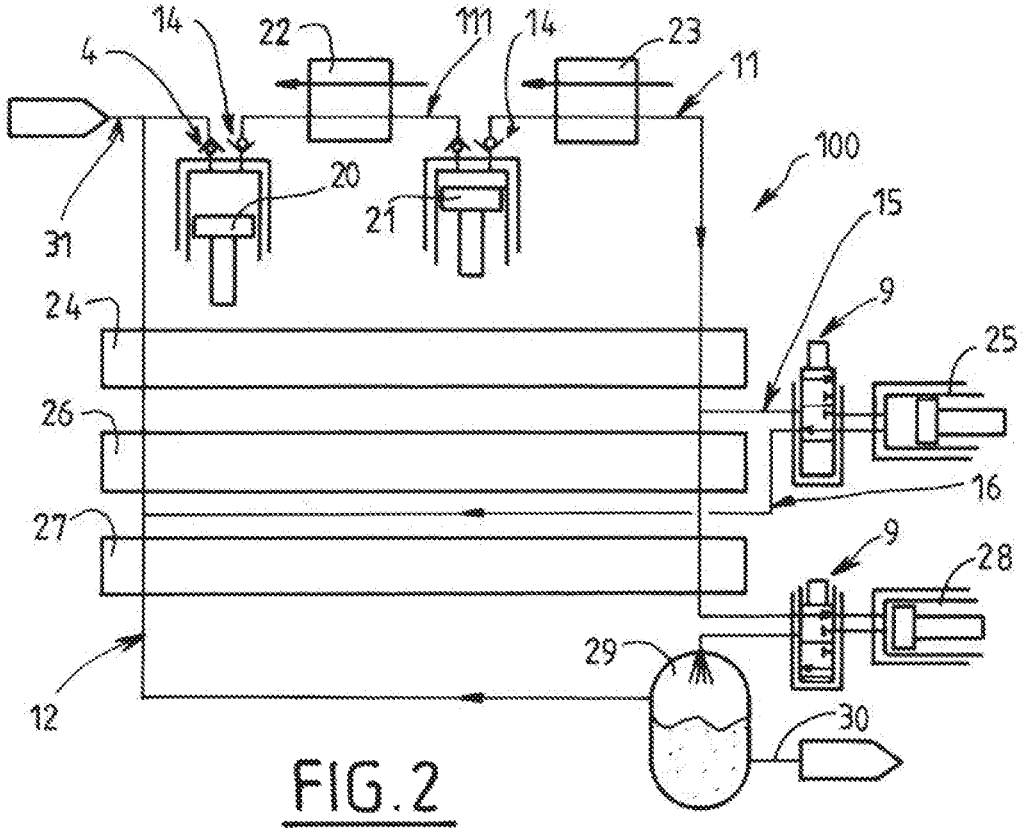
FIG. 2 depicts a schematic and partial view illustrating another example of the structure and operation of a liquefaction device according to the invention.

The FIG. 2 illustrates another illustrative embodiment of the invention. This example represents a gas liquefaction unit, in particular hydrogen. This liquefaction unit utilizes the same principal elements as those described above.

The working gas (hydrogen), for example at 20° C. (in the gaseous phase), is compressed in two piston compressors 20 and 21 arranged in series.

At the outlet of each compressor 20, 21 (via a high-pressure line and a valve 14), the gas is cooled by a heat exchanger 22, 23. This hydrogen is then cooled on its way through a first counter-flow heat exchanger 24.

A part of the flow of cooled gas may be admitted in order to pass, via a derivation 15 comprising a first linear valve 9, through a first expander piston 25 in such a way as to extract heat from the hydrogen.

As noted above, this first piston expander 25 may be connected to the first compressor 20 via a linear motor (not depicted for the sake of simplification, but it may be of the same type as that described above). Likewise, the first expander may be coupled to a separate motor (alternator)).

The first control valve 9 upstream of the first expander 25 is actuated preferably via a linear motor (not depicted for the sake of simplification, but it may be of the same type as that described above).

The hydrogen (expanded or otherwise) may then be cooled on its way through a second counter-flow exchanger 26 and, if necessary, on its way through a third counter-flow exchanger 27. This hydrogen that has been expanded in the first expander 25 may be returned directly to the first compressor 20 (via the one or more counter-flow heat exchangers 24, 26. That is to say the hydrogen that has been expanded in the first expander 25 may be returned to the compressors without being subjected to a second expansion or cooling.

Downstream of the derivation 15, the remaining hydrogen is then expanded in a second linear expander 28 (via a linear control valve 9). The second expander 28 is preferably of the diphasic piston type in order to extract heat from the hydrogen for the purpose of liquefying it partially. This second piston expander 28 may be connected mechanically (coupled) to the second compressor 21 (via a linear motor not depicted for the sake of simplification as previously) or to a separate alternator.

The second control valve 9 situated upstream of the second expander 28 may also be actuated by a linear motor (not depicted for the sake of simplification).

The control valves 9 controlling the circulation of the fluid between the expanders 25, 28 and the compressors 20 may be actuated, if necessary, by one and the same common actuator.

The diphasic mixture obtained after passage into the second expander 28 may then be delivered to a cryogenic separator 29. The gaseous phase of the hydrogen is returned to the first compressor 20 through the counter-flow exchangers 27, 26, 24.

The resulting liquid phase may be delivered to a final user through a line 30 provided for this purpose. The circuit may include an inlet 31 for the supply of working fluid (for example upstream of the first compressor 20) in order to compensate for the sampling of liquid.

Of course, the working fluid used may be any fluid other than helium or hydrogen, for example nitrogen, methane, neon, oxygen or argon.

The working circuit may thus be of the open or closed type.

Of course, the invention is not limited to the examples of cycles and circuits illustrated in FIGS. 1 and 2. It is thus possible to envisage a multitude of different architectures, for example based on the Brayton, Joule Thomson or Claude cycles in particular.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context dearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A cryogenic refrigeration device comprising a working circuit intended to cool a working fluid circulating in said circuit, the working circuit comprising, arranged in series in a loop, a compression portion, a cooling portion, a portion with valve(s), an expansion portion and a reheating portion, in order to subject the working fluid to a recuperative working cycle comprising compression, then cooling, then expansion and then reheating to prepare for a new cycle, in which the compression portion comprises at least one compressor with a linear piston that is coupled to a shaft that is displaced in translation according to an alternating movement via linear electromagnetic motor, the alternating movement of translation of the shaft being driven by a system of magnetic coils that cooperate with magnets that are integral with the shaft or integral with a stator, the expansion portion comprises at least one expander with a linear piston, the portion with valve(s) comprises at least one regulating valve of the linear type actuated by a linear motor and controlled in order to supply or extract the working fluid to or from the at least one piston expander.

2. The refrigeration device of claim 1, wherein at least one of said at least one linear motor couples both at least one of said at least one compressor with a linear piston and at least one of said at least one regulating valve of the linear type.

3. The refrigeration device of claim 1, wherein at least one of said at least one expander with a linear piston is coupled to a linear alternator that is separate from the motor of the at least one compressor.

4. The refrigeration device of claim 1, wherein the working fluid is cooled to a temperature between 4K and 200 K.

5. The refrigeration device of claim 1, wherein said at least one compressor comprises a plurality of compressors with a linear piston.

6. The refrigeration device of claim 1, wherein said at least one expander with a linear piston comprises a plurality of expanders with a linear piston each associated with a respective regulating valve of the linear type.

7. The refrigeration device of claim 1, wherein:

said at least one regulating valve of the linear type comprises a first regulating valve of the linear type;

the working circuit comprises a high-pressure line connecting a high-pressure outlet of one of said at least one compressor to the inlet of one of said at least one expander; and said high-pressure outlet comprises a non-return valve system, at least one heat exchanger for cooling the compressed gas, and the first regulating valve of the linear type.

8. The refrigeration device of claim 1, wherein:

said at least one regulating valve of the linear type comprises a first regulating valve of the linear type;

the working circuit comprises a low-pressure line connecting an outlet of one of said at least one expander to the inlet of one of said at least one compressor; and said low-pressure line comprises the first regulating valve of the linear type, at least one heat exchanger for reheating the expanded gas and a non-return valve system.

9. The refrigeration device of claim 8, wherein:

said at least one regulating valve of the linear type further comprises a second regulating valve of the linear type;

the working circuit comprises a high-pressure line connecting a high-pressure outlet of one of said at least one compressor to the inlet of one of said at least one expander;

said high-pressure outlet comprises a non-return valve system, at least one heat exchanger for cooling the compressed gas, and the second regulating valve of the linear type; and the at least one heat exchanger comprises a counter-flow heat exchanger bringing the working fluid circulating in the high-pressure and low-pressure line into thermal exchange.

10. The refrigeration device of claim 9, wherein the at least one heat exchanger brings the working fluid into thermal exchange with at least one fluid from among water, air, nitrogen, helium, hydrogen, methane, neon, oxygen or argon.

11. The refrigeration device of claim 1, wherein at least one of said at least one regulating valve of the linear type is actuated by its linear motor at a same frequency as an operating frequency of one of said at least one expander with a linear piston, for which the valve controls the supply or the withdrawal of working fluid, albeit in an out-of-phase manner in relation to the actuation of the piston expander.

12. The refrigeration device of claim 1, wherein:

said at least one compressor with a linear piston comprises, arranged in series, a first compressor with a first linear piston and a second compressor with a second linear piston;

the working circuit further comprises a first high-pressure line connecting a high-pressure outlet of the first compressors to the inlet of the second compressor via a non-return valve system and a second high-pressure line connecting a high-pressure outlet of the second compressor to the inlet of the first compressor via at least one heat exchanger in thermal exchange with the working fluid, a system of non-return valve(s), at least one of said at least one regulating valve of the linear type, and at least one of said at least one expander with a linear piston;

the at least one regulating valve being controlled in order to transfer fluid coming from the compressors and having exchanged thermally with the at least one heat exchanger to the at least one expander and then in order to transfer the expanded fluid coming from the at least one expander into the compressors with an intermediate thermal exchange with at least one heat exchanger.

13. The refrigeration device of claim 12, wherein the working circuit further comprises a phase separator arranged downstream of at least one of said at least one regulating valve in order to separate liquid and gaseous phases of the working fluid at the outlet of one of said at least one expander.

14. The refrigeration device of claim 13, wherein the working circuit further comprises a line for sampling liquefied working fluid and a line for supplying working fluid to or from the circuit in gaseous form.

15. The refrigeration device of claim 1, wherein at least one linear motor, which is the same as or different from the linear motor that drives the linear piston, couples at least one of said at least one expander with a linear piston which is the same as or different from the linear piston that is driven by the linear motor.

16. The refrigeration device of claim 15, wherein said at least one linear motor, that is the same as or different from the linear motor that drives the linear piston, couples at least one of said at least one compressor with a linear piston which is the same as or different from the linear piston that is driven by the linear motor.

17. The refrigeration device of claim 1, wherein at least one linear motor, which is the same as or different from the linear motor that drives the linear piston, couples at least one of said at least one compressor with a linear piston which is the same as or different from the linear piston that is driven by the linear motor.

* * * * *